US005328384A

United States Patent [19]

Magnuson

[11] Patent Number: 5,328,384

[45] Date of Patent: Jul. 12, 1994

[54] EXTENSION CORD RETAINING DEVICE

[76] Inventor: Jess W. Magnuson, 13552 Brett Harte Dr., Lakeside, Calif. 92040

[21] Appl. No.: 91,296

[22] Filed: Jul. 15, 1993

[51] Int. Cl.[5] ..... H01R 13/62

[52] U.S. Cl. ..... 439/369

[58] Field of Search ..... 439/367, 369, 370

[56] References Cited

U.S. PATENT DOCUMENTS

| | | | |
|---|---|---|---|
| 2,761,109 | 8/1956 | Hacker | 439/369 |
| 3,029,408 | 4/1962 | Anderson | 439/369 |
| 3,609,638 | 9/1971 | Darrey | 24/81 |
| 4,204,738 | 5/1980 | Tillotson . | |
| 4,917,626 | 4/1990 | Barton | 439/369 |
| 5,069,634 | 12/1991 | Chiarolanzio | 439/353 |

*Primary Examiner*—Khiem Nguyen

*Attorney, Agent, or Firm*—Rhodes & Ascolillo

[57] ABSTRACT

An apparatus for detachably holding the ends of two cords together has a first retaining rod and a first cord retaining hook on one end of the first retaining rod. A securing clamp is attached to the first retaining rod. The securing clamp has a rod receiving member, a rod receiving channel in the rod receiving member, a threaded clamping channel in the rod receiving member and a clamping screw threadingly engaged with the threaded clamping channel. A second retaining rod is releasingly and slidingly engaged within the securing clamp and releasingly engaged with the clamping screw. A second cord retaining hook is on one end of the second retaining rod. The clamping screw has a knurled gripping head.

2 Claims, 1 Drawing Sheet

EXTENSION CORD RETAINING DEVICE

BACKGROUND OF THE INVENTION

1. Field of the Invention

This invention relates to a device to retain the connection of two extension cords. The device reduces the chance that the male connection of one cord will be pulled loose from the female connection of another cord and disrupt the flow of electricity. It also allows the male and female connections of the same cord to be mated together in a secure manner to facilitate storage, transportation and security.

2. Description of the Related Art

The construction worker and the Do-it-yourselfer share a common problem. As time passes and they are deeply engrossed in the job, the need to move their tool a little further arises and all-of-the-sudden there is no longer any power to the tool. The extension cords that were being utilized have separated at their connections. Various devices have been devised to try to reduce this problem.

U.S. Pat. No. 3,609,638 to J. J. Darrey on Sep. 28, 1971 for an Extension Cord Coupling Clamp describes a clamp assembly having two spring-loaded clamps connected by a threaded length adjuster rod.

U.S. Pat. No. 4,204,738 to H. B. Tillotson on May 27, 1980 for an Electrical Connector Retaining device shows a retaining bail positioned on the male end of a cord that clamps over a resilient locking sleeve positioned near the female end of a cord.

U.S. Pat. No. 4,917,626 to P. S. Barton on Apr. 17, 1990 for a Cord Plug Coupling describes a device for holding the male and female ends of two cords together utilizing a hook and loop fastener.

U.S. Pat. No. 5,069,634 to M. J. Chiarolanzio on Dec. 3, 1991 for a Snap Lock Extension Cord and Power Tool Connector shows a specially constructed male and female cord end with the male end having a locking finger that interfaces with a locking port of the female end.

The present invention is adjustable and is designed to fit any combination of electrical plug connectors and equipment cords. It is simple to place on the cords and easy to adjust to the correct length to accommodate existing connector configurations.

SUMMARY OF THE INVENTION

The present invention is adjustable and designed to fit any combination of connectors. In one configuration, it may consist of two steel rods and a length of cold rolled steel bar stock. The rods may be approximately four inches long and 3/32's inch in diameter. The bar stock may be ⅜'s inch long and ⅜'s inch in diameter. (Other lengths and diameters may be used depending on the use.) The loops on the ends of the rods are bent to form an arc to accommodate the diameter of the cords expected to be encountered. A hole is bored in the bar stock to receive the rod. Another hole is bored in the bar stock, then taped and threaded to receive a threaded bolt with a knurled, finger gripping surface thereon. The threaded bar stock is then attached to one of the rods by brazing or welding.

In one embodiment, an apparatus for detachably holding the ends of two cords together is described that has a first retaining rod and a securing clamp attached to the first retaining rod. A second retaining rod is releasingly and slidingly engaged with the securing clamp.

In another embodiment, an apparatus for detachably holding the ends of two cords together is described that has a first retaining rod and a first cord retaining hook on one end of the first retaining rod. There is a securing clamp attached to the first retaining rod. A second retaining rod is releasingly and slidingly engaged with the securing clamp and there is a second cord retaining hook on one end of the second retaining rod.

It is an object of this invention to provide a device to detachably secure a male connector of either one cord to the female end of another cord or to detachably secure a female connector to the male connector of the same cord together.

DESCRIPTION OF THE PREFERRED EMBODIMENTS

Figure 3:
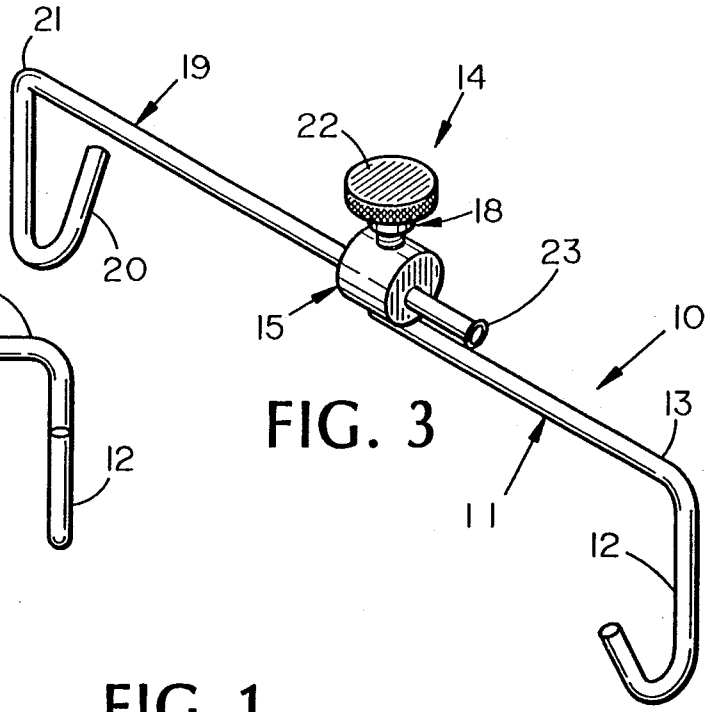
FIG. 3 is a perspective view of the Extension Cord Retaining Device.
Figure 2:
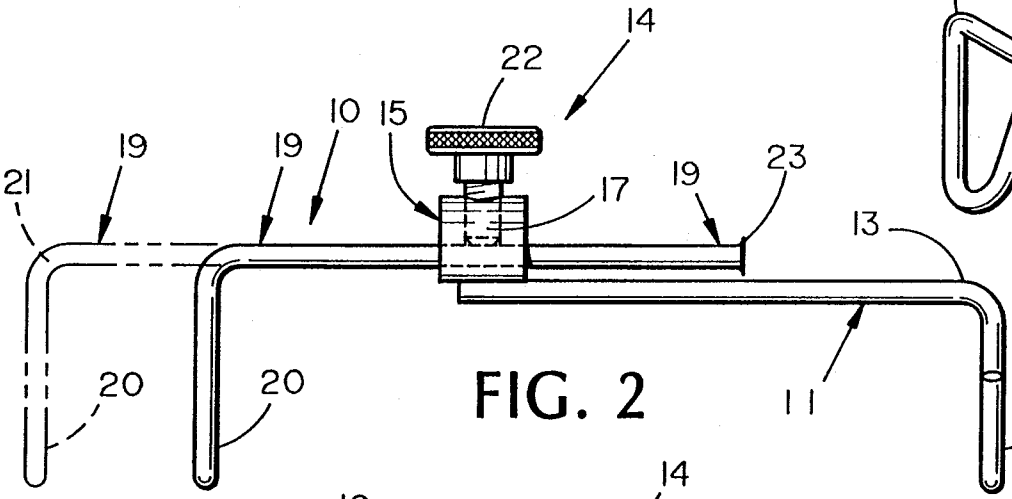
FIG. 2 is a front elevational of an Extension Cord Retaining Device showing the second retaining rod extended to a greater length (in phantom).
Figure 1:
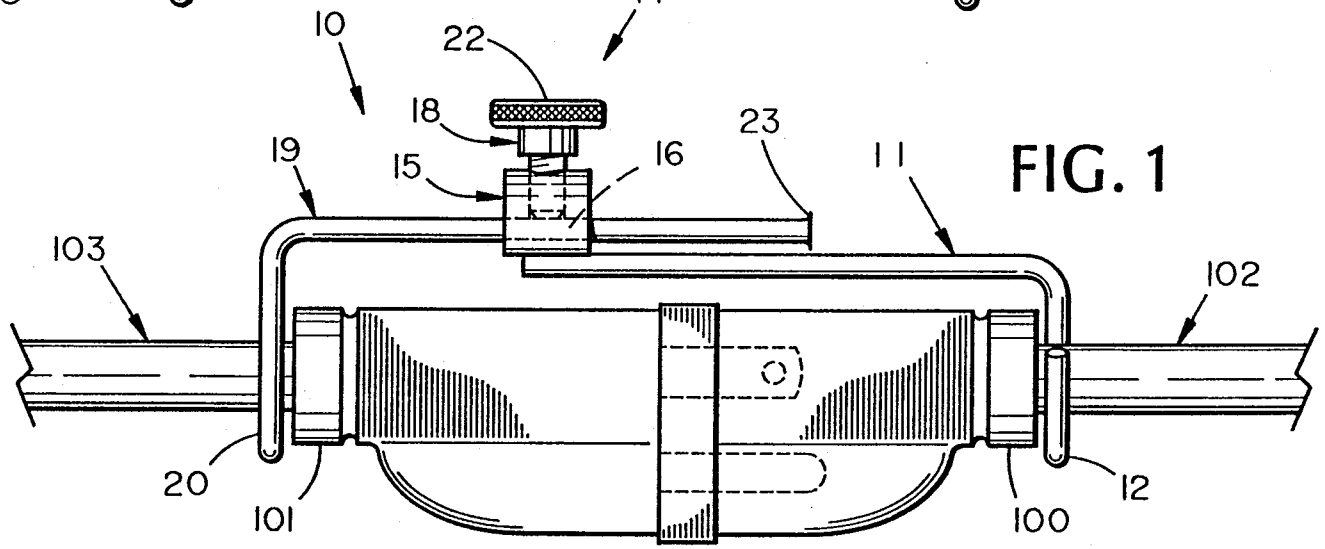
FIG. 1 is a front elevational view of an Extension Cord Retaining Device shown securing a male and a female cord connector together.

Referring to FIGS. 1 through 3, an apparatus 10 for detachably holding the ends 100 and 101 of two cords 102 and 103 together is shown and described that has a first retaining rod 11 and a first cord retaining hook 12 on one end 13 of the first retaining rod 11. There is a securing clamp 14 attached to the first retaining rod 11 that has a rod receiving member 15. A rod receiving channel 16 is in the rod receiving member 15. There is a threaded clamping channel 17 in the rod receiving member 15 and a clamping screw 18 is threadingly engaged with the threaded clamping channel 17.

A second retaining rod 19 is slidingly engaged within the securing clamp 14 and releasingly engaged with the clamping screw 18.

At one end of the second retaining rod 19 is a splayed tip member 23 for preventing the second retaining rod 19 from sliding completely out from the rod receiving channel 16 in the rod receiving member 15.

There is a second cord retaining hook 20 on the other end 21 of the second retaining rod 19. The clamping screw 18 has a knurled gripping head 22 to aid in tightening and loosening.

Operation of the apparatus 10 is best described by referring to the figures. Upon electrical connection of two ordinary power cords 102 and 103, apparatus 10 is then employed as follows: Clamping screw 18 is sufficiently loosened to a point where the second retaining rod 19 slides freely about the rod receiving channel in the rod receiving member 15. Cords 102 and 103 are then positioned within the first and second retaining hooks 12 and 20, respectively. At this point, first and second retaining rods 11 and 19 are slid toward one another until the ends 100 and 101 of cords 102 and 103 prevent further such movement by virtue of their larger outside diameters. The clamping screw 18 is then appropriately tightened, locking first and second retaining rods 11 and 19 in place. Thus, it can be seen that, upon application of a pulling force to opposite ends of cords 102 and 103, the retaining hooks 12 and 20 of the apparatus 10 firmly hold cords 102 and 103 in place, as ends 100 and 101 are not allowed to pass therethrough.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An apparatus for detachably holding the ends of two cords together comprising:

(a) a first retaining rod;

(b) a first cord retaining hook on one end of the first retaining rod;

(c) a securing clamp attached to the first retaining rod comprising:

a rod receiving member;

a rod receiving channel member in the rod receiving member; and a clamping screw threadingly engaged within the threaded clamping channel;

(d) a second retaining rod slidingly engaged within the securing clamp and releasingly engaged with the clamping screw;

(e) a second cord retaining hook on a first end of the second retaining rod; and (f) retaining means for preventing the second retaining rod from disengaging with the securing clamp, comprising a splayed tip at a second end of the second retaining rod.

2. A apparatus as described in claim 1 wherein the clamping screw further comprises a knurled gripping head.

* * * * *